United States Patent [19]

Bienwald

[11] Patent Number: 4,476,359

[45] Date of Patent: Oct. 9, 1984

[54] PUSH-BUTTON ELECTRICAL SWITCH WITH UNITARY SPIRAL STEM AND WASHER

[75] Inventor: Wolfgang F. Bienwald, Melville, N.Y.

[73] Assignee: Leviton Manufacturing Company, Inc., Little Neck, N.Y.

[21] Appl. No.: 431,965

[22] Filed: Sep. 30, 1982

[51] Int. Cl.[3] ..... H01H 3/00

[52] U.S. Cl. ..... 200/156; 200/153 J

[58] Field of Search ..... 200/156, 153 J, 340, 200/252, 260, 11 R, 11 G

[56] References Cited

U.S. PATENT DOCUMENTS

| | | | |
|---|---|---|---|
| 1,361,609 | 12/1920 | Ohrstrom | 200/156 |
| 2,096,386 | 10/1937 | Taubner | 200/156 X |
| 2,195,237 | 3/1940 | Bryant et al. | 200/156 |
| 2,836,691 | 5/1958 | Di Girolamo et al. | 200/156 |

FOREIGN PATENT DOCUMENTS

| | | | |
|---|---|---|---|
| 167816 | 5/1954 | Australia | 200/156 |
| 254046 | 8/1910 | Fed. Rep. of Germany | 200/156 |
| 623803 | 9/1932 | Fed. Rep. of Germany | 200/156 |
| 619921 | 7/1926 | France | 200/156 |
| 16078 | of 1911 | United Kingdom | 200/156 |

*Primary Examiner*—Charles E. Phillips
*Assistant Examiner*—Ernest G. Cusick
*Attorney, Agent, or Firm*—Paul J. Sutton

[57] ABSTRACT

The conventional push-button switch which is generally found on lamps and appliances is constructed so that the depressing the push-button causes a rotary switch motion within the body on the switch. The components which convert the linear motion of the push-button have consisted of a metal spiral stem and a cooperating metal push-button. In addition the spiral stem has stem provided with a washer at its lower extremity.

The present invention provides for the spiral stem and washer to be molded as a single plastic component. The cooperating push-button is provided as a plastic component or as a metal component with a plastic insert. The improvement described serves to reduce the number of component parts in a push-button switch as well as isolating the operator of the push-button from the internal electrical components.

8 Claims, 9 Drawing Figures

PUSH-BUTTON ELECTRICAL SWITCH WITH UNITARY SPIRAL STEM AND WASHER

BACKGROUND OF THE INVENTION

1. Field of the invention:

The present invention generally relates to electrical switches and specifically to push-button switches with internal rotary motion.

2. Prior Art

Switches which convert the linear motion of a push-button to the rotary motion of a switch are well-known in the art. These push-button switches are generally found on a multiplicity of appliances and are constructed primarily of metal components. The prior art has employed a brass spiral system which is coupled to a fiber disk as an internal component of the switch. The brass spiral stem engages the push-button in such a manner as to cause the spiral stem to rotate above its longitudinal axis as the push-button is depressed. Rotation of the spiral stem results in the coupled fiber disk causing the rotary movement of an abuting commutator. Rotation of the metallic commutator causes the wiping fingers attached to the commutator to make or break the electrical circuit connected to the push-button switch wires.

With the increased application of the push-button switch the new uses found may subject the push-button switch to conditions which are not the most ideal for its proper functioning. Under high humidity conditions the fiber disk of the prior art switch may not provide sufficient electrical isolation between the commutator and the user operated push-button. The aforedescribed situation may present a potential danger to the user under certain conditions, such as the aforementioned one of high humidity.

Additionally, the brass spiral stem operating with the conventional metal push-button must be prelubricated during switch assembly for proper operation of the push-button during its life. If for some reason the brass spiral stem is not prelubricated or the lubrication which has been provided gravitates to a nonworking area of the spiral stem, the push-button switch will have a shortened life. The lack of lubrication in the working area of the spiral stem causes excessive friction between moving parts with consequent wearing of the parts. Eventually binding of the push-button switch occurs and replacement is required.

SUMMARY OF THE INVENTION

It is therefore an object of the present invention to provide for a push-button electrical switch having improved insulation characteristics between the electrical switch and the push-button.

Another object of the present invention is to reduce the number of parts in a push-button electrical switch.

Still another object of the present invention is to increase the reliability of a push-button electrical switch.

Yet another object of the present invention is to provide for a push-button electrical switch with a longer operating life.

A further object of the present invention is to provide for a push-button electrical switch which is inexpensive to manufacture.

Other and further objects of the invention will be apparent from the following drawings and description of the preferred embodiment of the invention in which like reference numerals are used to designate like parts in the various views.

DESCRIPTION OF THE PREFERRED EMBODIMENT

Figure 1:
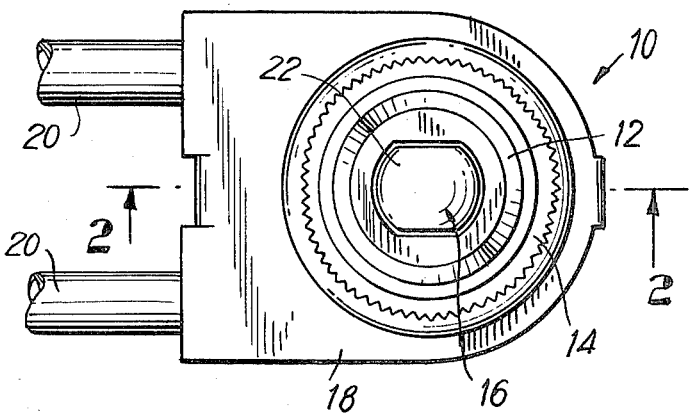
FIG. 1 is a top plan view of the push-button electrical switch.

Reference to FIG. 1 shows a push-button switch 10 incorporating the present invention. The plan view seen in FIG. 1 further shows a threaded bushing 12 which is used to support a push-button 16. The threaded bushing 12 supports a threaded nut 14 and is attached to a switch cover 18 by standard manufacturing techniques. The push-button switch 10 has a pair of wires 20 for connecting the switch 10 to the electrical circuit it controls.

Figure 2:
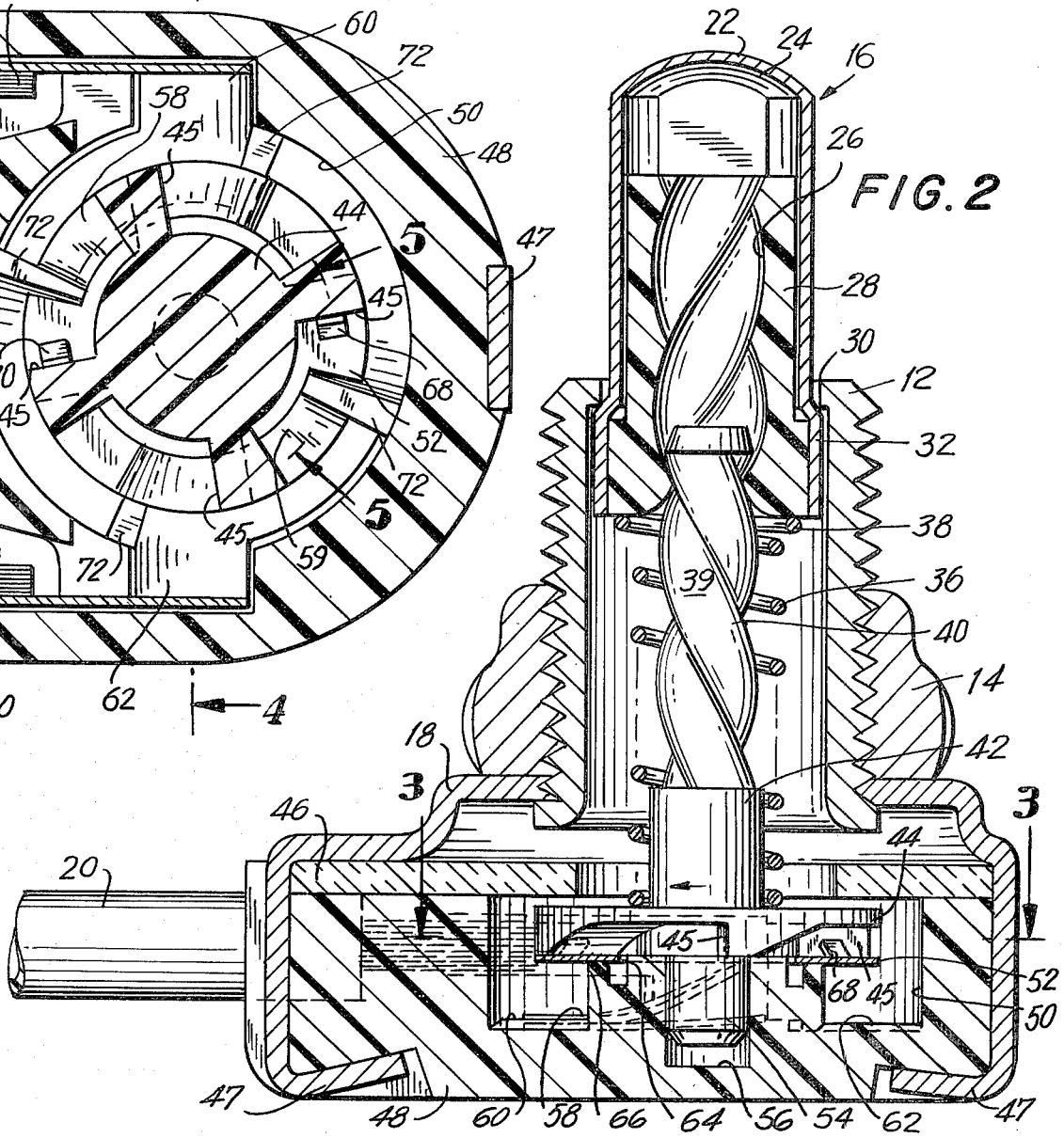
FIG. 2 elevational cross-sectional view taken through line 2—2 of FIG. 1.

Internal elements of the present invention are best seen in FIG. 2 which is a section taken through the line 2—2 of FIG. 1. The threaded bushing 12 is seen to be fixed to the switch cover 18 by standard manufacturing processes. A switch body 48 is attached to the switch cover 18 by a set of tabs 47 which are staked to the switch cover 18 as shown in FIG. 2. During the assembly process an insulator 46 is inserted between the switch cover 18 and the switch body 48.

Returning to the threaded bushing 12 of FIG. 2 there is shown a lip portion 30 which serves to retain the push-button 16 once it has been assembled. The push-button 16 is seen to consist of a dome-shaped metal shell 22 having a shoulder 32 which cooperates with lip 30 of the threaded bushing 12 to limit movement of the domed metal shell 22. Within the domed metal shell 22 is a plastic insert 28 having axially disposed a spiral hole 26 covered by a cap 24. Cooperating with a spiral hole 26 is a spiral stem piece 40 which has been partially inserted into the spiral hole 26 during assembly of the push-button switch 10.

At an end opposite to the end inserted into the spiral hole 26 the spiral stem piece 40 is provided with a pilot shaft 54 which is seated in a pilot hole 56. The pilot hole 56 has been molded into a switch cavity 50 which is part of the switch body 48. In addition to the pilot hole 56 there is centrally placed a locating diameter 64 and concentric with that a locating surface 66. Resting on the locating surface 66 is a commutator 52 having a hole which is slightly larger in diameter than the locating diameter 64. The preceding condition allows the commutator 52 to freely rotate about the locating diameter 64.

Returning to the spiral stem piece 40 there can be seen a stem base diameter 42. On the stem base diameter 42 is shown an arrow indicating the direction of movement when the push-button is depressed. Concentric with the spiral stem piece 40 is a washer 44. The washer 44 is provided with a set of four driving edges 45 spaced 90 degrees apart. The stem base diameter 42 is seen to be concentric with a helical compression spring 36. The helical compression spring 36 is provided with an end turn 38 which is seated against the bottom portion of the pushbutton 16. Returning our attention to the commutator 52 we find that a second tooth 68 is shown in contact with one of the driving edges 45. Also shown is a first arm 58 which is part of the commutator 52 and is seen to make breakable connection with a first contact 60. A portion of the second contact 62 is seen to the right of the switch cavity 50.

Figure 3:
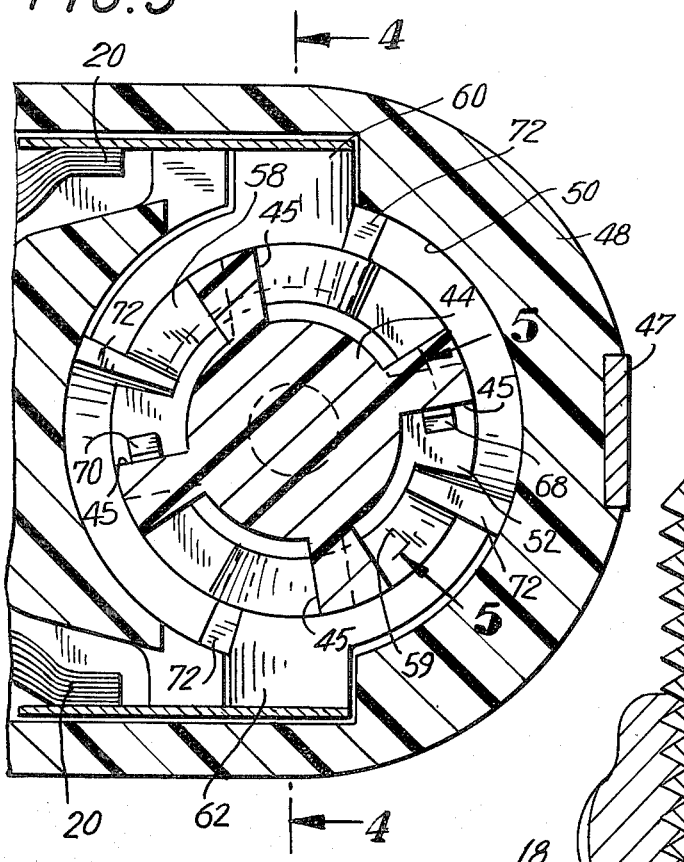
FIG. 3 plan cross-sectional view taken through line 3—3 of FIG. 2.

Reference to FIG. 3, which is a section taken through line 3—3 of FIG. 2 shows details of the commutator 52, the arrow showing the movement of the commutator 52. In the present figure the commutator 52 is seen to have the first tooth 68 previously shown in FIG. 2 and a second tooth 70. Both of the aforementioned teeth are in contact with one of the driving edges 45. A fuller description of the washer 44 will be given later. Again referring to the present FIG. 3, the commutator 52 is shown to have the first arm 58 and a second arm 59 which are respectively in contact with the first contact 60 and the second contact 62. Each of the contacts 60 and 62 have a wire 20 attached, preferably by the spot welding process. The switch body 48 has a series of cavity flats 72 which form part of the switch cavity 50; The function of cavity flats 72 will be expanded upon later in the specification.

Figure 4:
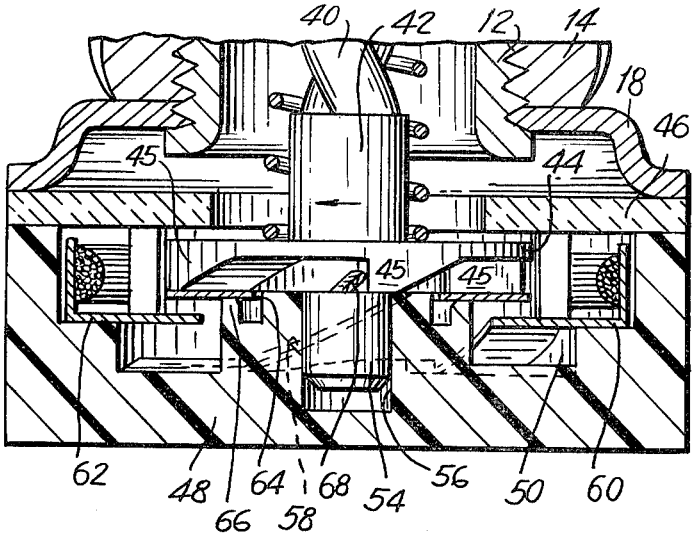
FIG. 4 elevational cross-sectional view taken through line 4—4 of FIG. 3.

Reference to FIG. 4 shows a partial section through line 4—4 of FIG. 3. Here may be seen a different view of the contact and commutator relationship. Seen here is the spiral stem 40 affixed to the stem base diameter 42. Shown on the stem base diameter 42 is an arrow which represents the movement of the part when the push-button 16 is depressed. Below the stem base diameter 42 is the washer 44 and molded integral with the lower surface of the washer 44 are the driving edges 45. Immediately below the driving edges 45 is the commutator 52. Shown in contact with one of the driving edges 45 is the first tooth 68 which is part of the commutator 52. The commutator 52 is seen to be in contact with the locating diameter 64 and the locating surface 66. Also shown is the pilot shaft 54 being retained in the pilot hole 56. Disposed in opposite sides of the switch cavity 50 are the second contact 62 and the first contact 60. The first arm 58 of the commutator 52 is shown as a dotted line since it is in the rear of the switch cavity 50.

Figure 5:
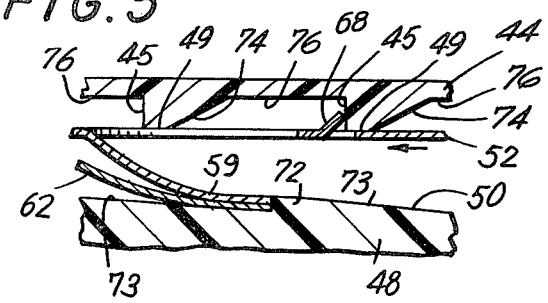
FIG. 5 partial elevational view taken through line 5—5 of FIG. 3.

FIG. 5 is a partial cross-section taken through lines 5—5 of FIG. 3. Here is illustrated more of the cooperation between the washer 44, the commutator 52 and the switch cavity 50. FIG. 5 is seen to display two of the driving edges 45. Driving edges 45 are vertical and immediately to the right of each driving edge 45 is a first washer flat portion 49 which is in contact with the commutator 52. The aforementioned flat portion 49 is then followed by a washer sloping portion 74 which then leads into a second washer flat portion 76. The washer flat portion 76 then terminates at the vertical driving edge 45. The first tooth 68 of the commutator 52 is seen to be abutting the driving edge 45 which is in the right hand portion of FIG. 5. Just below the commutator 52 is an arrow which shows the direction of movement for the commutator 52.

Directing our attention to the lower portion of FIG. 5, we see the bottom of the switch cavity 50. Molded into the switch body 48 material, which is preferably plastic, is a cavity flat 72 and a set of 73 inclines 73. The second contact 62 is seen to be nested in the pocket formed by the left-hand incline 73. Resting on the second contact 62 is the second arm 59 which is shown depending from the commutator 52.

Figure 6:
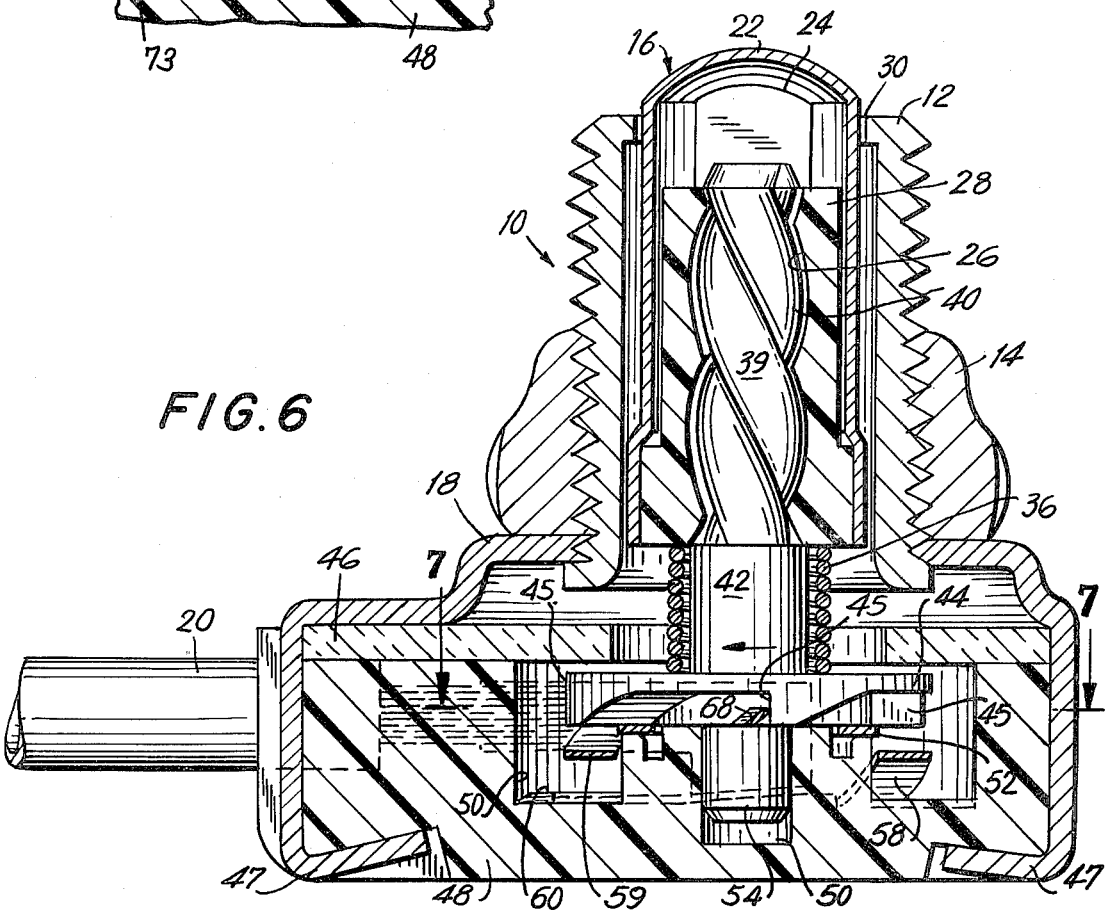
FIG. 6 elevational cross-sectional view of push-button electrical switch, push-button depressed.

Referring to FIG. 6 there is shown a cross-section similar to that shown in FIG. 2 except for the fact that the push-button is shown depressed. The construction of the switch 10 is the same as that of FIG. 2. What is of interest here is that with the depression of the push-button 16 the spiral stem 40 causes the washer 44 to rotate in the direction of the arrow found on the stem base diameter 42. Rotation of the washer 44 has caused rotation of the commutator 52 since the driving edge 45 is in contact with the first tooth 68. Rotation of the commutator 52 then results in rotation of the first arm 58 and the second arm 59 both of which depend from the commutator 52.

Figure 7:
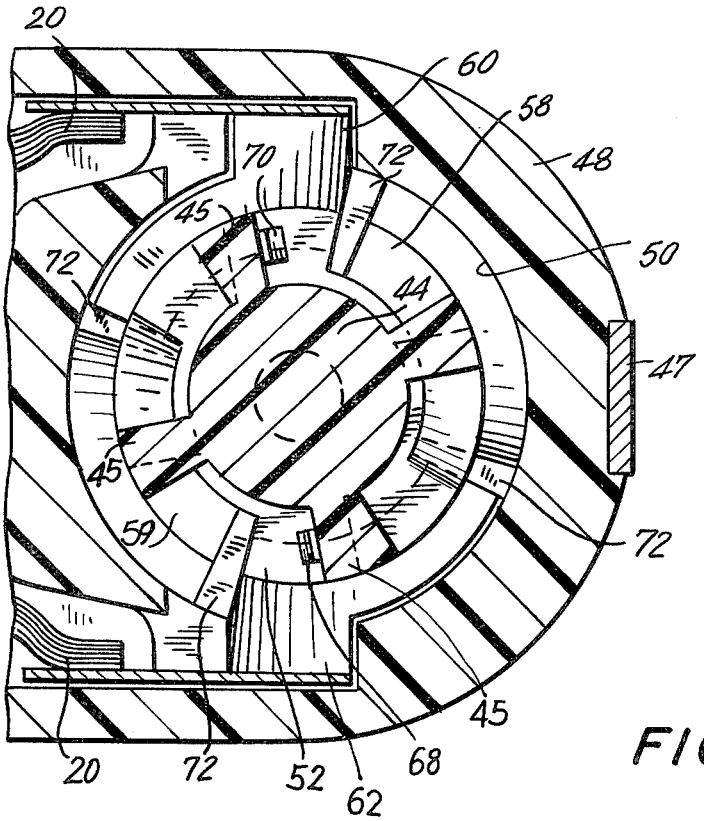
FIG. 7 is a plan cross-sectional view taken through line 7—7 of FIG. 6.

FIG. 7 shows a cross-section taken through line 7—7 of FIG. 6. The cross-section shown in FIG. 7 is similar to that shown in FIG. 3 except for the fact that the commutator 52 has been caused to rotate 90 degress. The 90 degree rotation of the commutator 52 requires that the arms 58 and 59 depending therefrom to also rotate as has been noted in the preceding paragraph. The arms 58 and 59 now occupy portions of the switch cavity 50 which does not contain the contacts 60 and 62.

Figure 8:
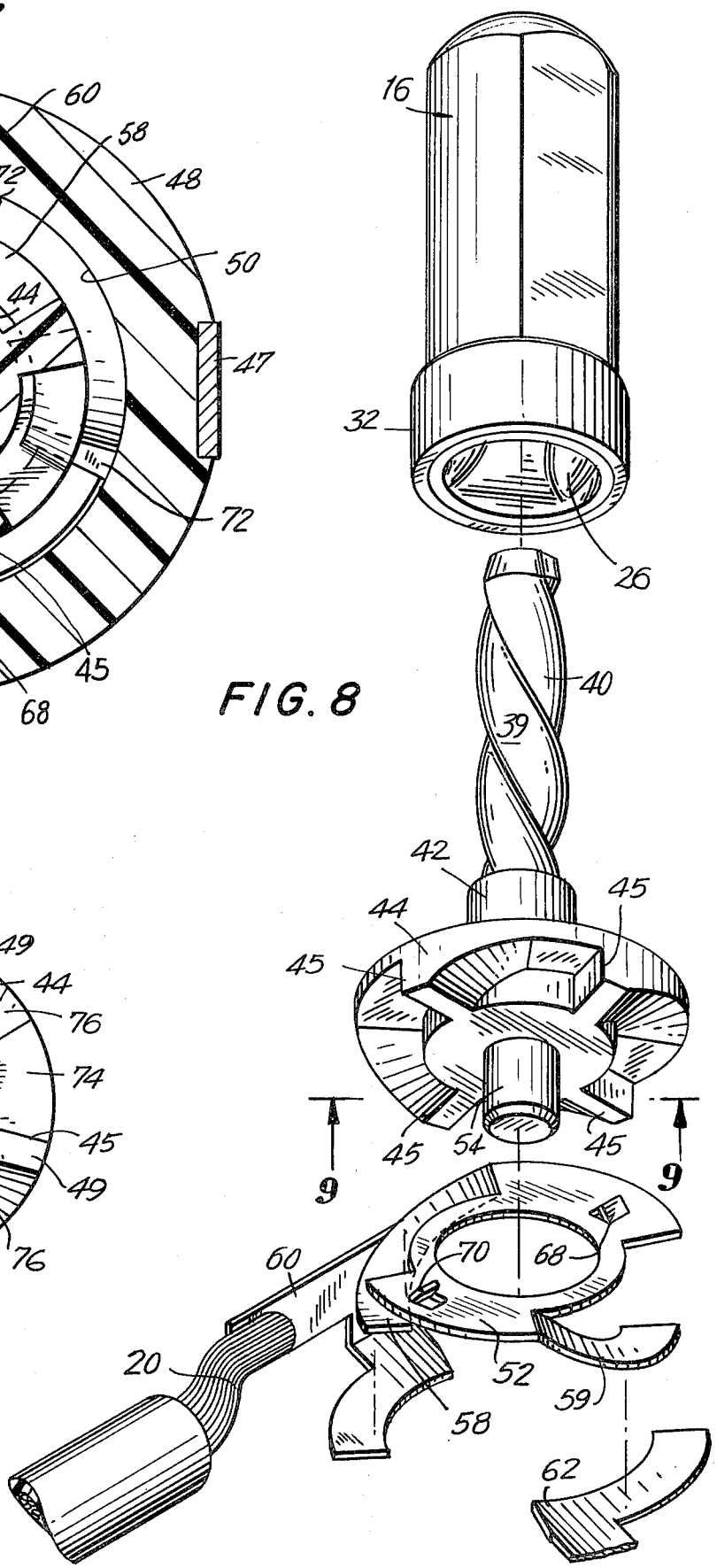
FIG. 8 is an exploded view of the main components of the push-button of the push-button electrical switch.

Reference to FIG. 8 shows an exploded view of the main components or the push-button switch 10. Here can be seen the one piece molding of the spiral stem 40, the stem base diameter 42, the washer 44 and the pilot shaft 54. Just above the spiral stem 40 is the push-button 16 having at its lower extremity the push-button shoulder 32 and the spiral hole 26 occupying the internal portion of the push-button 16. Just below the pilot shaft 54 is the commutator 52 with an arrow alongside showing the direction of movement of the commutator 52 during operation of the pushbutton switch 10. Seen on the topmost surface of the commutator 52 is the first tooth 68 and the second tooth 70. Also seen depending from the commutator 52 is the first arm 58 and the second arm 59. Immediately below and in the correct relative position is the first contact 60 and the second contact 62. The foregoing relative position is that which causes the first contact 60 and the second contact 62 to be connected together by the commutator 52.

Figure 9:
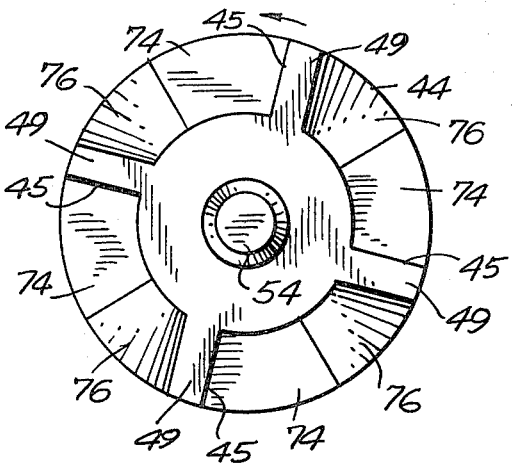
FIG. 9 is a plan view taken through line 9—9 of FIG. 8.

FIG. 9 is a cross-section taken through line 9—9 of FIG. 8 and shows the ratchet tooth nature of the undersurface of the washer 44. FIG. 9 shows that each one of the driving edges 45 is 90 degrees from an adjacent one. Immediately adjacent to each driving edge 45 is a first washer flat portion 49 followed by a washer sloping portion 74 and a second washer flat portion 76. The line forming the junction between washer flat portion 76 and washer sloping portion 74 makes a 45 degree angle with each driving edge 45 immediately adjacent to the line. The foregoing contour is repeated four times and can best be seen in FIG. 8.

OPERATION OF THE PREFERRED EMBODIMENT

FIG. 1 shows the push-button electrical switch 10 of the present invention. The cross-section taken through line 2—2 and shown in FIG. 2 shows the present invention in greater detail. The present invention employs a spiral piece 39 which is comprised of the spiral stem 40, the stem base diameter 42, the washer 44 and the pilot shaft 54. The spiral piece 39 is molded as one piece and is preferrably made of nylon but may be made of other plastic materials. Heretofore prior art switches were comprised of at least two separate components, namely, the spiral stem made of brass and the washer made of an insulating material. The present invention also employs the spiral hole 26 which is molded in the plastic insert 28, part of the push-button 16. The plastic insert 28 is preferably made of nylon, and when the spiral hole 26 operates with the spiral stem 40, the plastic parts are self-lubricating. Prior art switches utilize a metal component mounted in the push-button 16 which engages the prior art spiral stem made of brass. The prior art assembly obviously requires that a lubricating agent be provided. The self-lubricaring quality of the present invention is an advance in the art which results in a less expensive and better operating product.

It is obvious, from inspecting FIG. 2, FIG. 6 and FIG. 8, that as the spiral stem 40 enters the spiral hole 26 the washer 44 will rotate in the direction shown by the arrow found on the stem base diameter 42. The spiral hole 26 is part of the plastic insert 28 which occupies the interior of the push-button 16. Reference to FIG. 1 shows that the push-button 16 is not round but has flattened sides and is fitted into a similarly shaped opening in the threaded bushing 12. Consequently, when the push-button 16 is pushed down by the user, the helical compression spring 36 is caused to compress as shown in FIG. 6, and since the opening in the threaded bushing 12 prevents rotation of the push-button 16, rotation of the spiral stem 40 occurs. Release of the depressed push-button 16 by the user allows the helical compression spring 36 to extend itself. The push-button 16 is then returned to the extended position shown in FIG. 2. The push-button 16 is maintained in the extended position by the force of the helical compression spring 36 causing the push-button shoulder 32 to abut the lip 30 found on the threaded bushing 12. When the push-button 16 returns from the position it assumes in FIG. 6 to that assumed in FIG. 2, the washer 44 is caused to rotate in the direction opposite to that shown by the arrow found on the stem base diameter 42. Therefore, the spiral piece 39 rotates in one direction when the push-button 16 is depressed and in the reverse direction when the push-button 16 is allowed to return to its original position.

Sandwiched between the washer 44 and the locating surface 66 is the commutator 52. The force provided by the helical compression spring 36 ensures that the commutator 52 remains in movable proximity to the locating surface 66. Further, the commutator 52 is constrained to move concentric with the washer 44 by the locating diameter 64. It is the commutator which performs the electrical switching for the push-button electrical switch 10. Reference to FIG. 2, FIG. 3, FIG. 4, FIG. 5 and FIG. 8, which all show the push-button switch 10 in the same mechanical and electrical position, shows that the commutator 52 has the first arm 58 and the second arm 59 depending from the flat washer-like portion of commutator 52 containing the first tooth 68 and the second tooth 70. The arms 58 and 59 are seen to be in electrical and mechanical contact with the first contact 60 and the second contact 62. The contacts 60 and 62 are nested in preselected portions of the switch cavity 50. Each of the contacts 60 and 62 has attached a wire 20 for connection to the electrical switch 10. It will be noted that the switch cavity 50 is comprised of four chambers separated by the cavity flats 72. FIGS. 3 and 7 show that the contacts 60 and 62 are located opposite each other with an empty chamber on each side of each contact.

FIGS. 2, 3, and 4 show the first tooth 68 and the second tooth 70 of the commutator 52 in contact with a driving edge 45 of the washer 44. Depressing the push-button 16 as seen in FIG. 6 causes the driving edge 45 to rotate since it is part of the washer 44. Movement of the driving edge 45 necessarily causes the first tooth 68 and the second tooth 70 to move the commutator 52. FIG. 6 shows that the arms 58 and 59 have been moved into the empty chambers hereinbefore described. Movement of the arms 58 and 59 into the empty chambers of the switch cavity 50 provides for an electrical disconnect of the electrical circuit controlled by the push-button electrical switch 10.

When the push-button 16 is released, the washer 44 reverses direction of rotation, and because of frictional effects the commutator 52 is urged to also reverse direction. In truth the commutator 52 may attempt to reverse direction and as it does so both arms 58 and 59 engage the vertical transition between the cavity incline 73 and the cavity flat 72, best seen in FIG. 5 where only the second arm 59 is shown. The interference provided by the vertical transition described above effectively prevents reverse rotation of the commutator 52. Although the commutator 52 cannot reverse direction the washer 44 can and does reverse direction. The washer 44 rotates forward and reverse on the order of 90–100 degrees. On the reverse rotation of the washer 44 the commutator 52 is prevented from following; therefore, the washer driving edges 45 must pass the teeth located on the commutator 52. The foregoing is facilitated by the washer slopes 74 surfaces making contact with the teeth 68 and 70. While washer 44 returns to its initial position the washer 44 rides over the teeth 68 and 70 on the washer slope 74 surface. The helical compression spring 36 permits the movement of the washer 44 upwardly relative to the commutator 52.

The spiral stem of this embodiment has been molded with a 218 degrees twist which has proved satisfactory. This angle specified does not preclude the use of other angular twists. Additionally, an alternate embodiment had been operable in which the entire push-button 16 comprises a unitary plastic molding rather than an assembly of components as shown in the figures.

The embodiments of the invention particularly disclosed and described hereinabove are presented merely as examples of the invention. Other embodiments, forms and modifications of the invention coming within the proper scope and spirit of the appended claims will of course readily suggest themselves to those skilled in the art.

What is claimed is:

1. An improved push-button electrical switch, comprising:

a housing;

a set of wires extending from a first portion of said housing for connection to an external circuit;

a push-button member extending from a second portion of said housing;

spring disposed between said push-button member and an internal portion of said housing for keeping said push-button member extended from said housing, said push-button member being operatively connected with means for converting linear motion to rotary motion comprising a unitary piece having a spiral stem portion and a driving washer portion, said push-button member including an elongated insert member forming an elongated spiral hole adapted to receive said spiral stem portion during axial linear operation of said unitary piece, and a stop means for preventing said push-button member and said insert member from rotating during linear axial operation of said unitary piece, said driving washer portion of said unitary piece cooperating with a commutator having rotary movement and means for making electrical connection to a pair of contacts disposed within said housing and connected to said set of wires whereby axial motion of said push-button member causes said commutator to have rotary movement so as to alternately connect and disconnect said pair of contacts.

2. The apparatus of claim 1 wherein said insert member is molded of nylon.

3. The apparatus of claim 2 wherein said push-button member including said insert member is comprised of a single unitary molding.

4. The apparatus of claim 1 wherein said spiral stem portion is provided with a 218 degree twist.

5. The apparatus of claim 1 wherein said washer portion includes a plurality of pairs of driving edges for cooperating with said commutator.

6. The apparatus of claim 5 wherein said washer portion includes 4 driving edges.

7. The apparatus of claim 6 wherein said washer portion includes a sloping surface disposed between each said pair of said driving edges.

8. The apparatus of claim 7 wherein said washer portion includes 4 sloping surfaces and 4 driving edges.

* * * * *